US007559796B1

(12) United States Patent
Wu

(10) Patent No.: US 7,559,796 B1
(45) Date of Patent: Jul. 14, 2009

(54) PANEL-MOUNT CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/080,456

(22) Filed: Apr. 3, 2008

(51) Int. Cl.
*H01R 13/73* (2006.01)

(52) U.S. Cl. ..... 439/564; 439/573

(58) Field of Classification Search ..... 439/564, 439/565, 573
See application file for complete search history.

(56) References Cited

U.S. PATENT DOCUMENTS 6,176,728 B1 1/2001 Bonnet et al.
6,648,676 B1 * 11/2003 Lee ..... 439/499
6,773,286 B1 * 8/2004 Wu ..... 439/247
6,824,419 B1 * 11/2004 Wu ..... 439/378
6,832,931 B1 * 12/2004 Wu ..... 439/499
6,890,200 B1 * 5/2005 Wu ..... 439/247
6,976,869 B1 * 12/2005 Wu ..... 439/499
7,044,782 B2 * 5/2006 Enami et al. ..... 439/564

FOREIGN PATENT DOCUMENTS

CN 2762206 3/2006

* cited by examiner

*Primary Examiner*—Thanh-Tam T Le
(74) *Attorney, Agent, or Firm*—Wei Te Chung

(57) ABSTRACT

A cable connector assembly (100) adapted for mounting to a panel (9) includes an insulated housing (1) having a base portion (11), a tongue portion (12) extending forwardly from the base portion and at least a mounting portion (13) integrated with the base portion; a plurality of contacts (2) assembled to the insulated housing, with mating portions thereof disposed on the tongue portion; at least a cable (5) electrically connecting to the contacts, at least a nut (6) permanently assembled to a mounting portion, and a bolt (7) combining with the nut (6) to fasten the cable connector assembly with the panel together.

15 Claims, 7 Drawing Sheets

PANEL-MOUNT CABLE ASSEMBLY

FIELD OF THE INVENTION

The present invention generally relates to a cable assembly, and more particularly to a cable assembly mountable to a panel of an electronic device.

DESCRIPTION OF PRIOR ART

A cable assembly is widely applied in an electronic devices, such a computer, sever, etc. The cable assembly is housed in an interior of the electronic device, serving as intermediate member and bridging the electronic device and other exterior electronic device. The cable assemble includes a cable coupled to an electrical connector and electronic components inside an cage of the electronic device, while the electrical connector is fixed to one side (panel portion) of the cage to form Input/Output (I/O) interface.

For example, CN Pat. No. 2762206 discloses a kind of cable assembly attached to a panel of an electronic device, including a connector, a number of cables connecting to the connector and further connected to other electronic components, and additional bolts and nuts applied to fasten the connector and the panel together. However, as the electronic device becomes lower profile, and any components thereof are also smaller, so do the bolts and nuts. Thus it is difficult for a user to hold the nuts and bolts simultaneously to mount the cable assembly to the panel.

Hence, an improved cable assembly is highly desired to overcome the aforementioned problems.

SUMMARY OF THE INVENTION

Accordingly, an object of the present invention is to provide a cable assembly which is easily and conveniently mounted to a panel.

In order to achieve the object set forth, an electrical connector in accordance with the present invention for interconnecting at least a cable and being mountable to a panel having an outlet therethrough and at least a mounting hole arranged alongside the outlet, the connector with a peripheral section thereof held in the outlet of the panel, comprising: an insulated housing including a base portion, a tongue portion extending forwardly from the base portion, and at least a mounting portion integrated with the base portion; a nut permanently assembled to the mounting portion adapted for aligning with the mounting hole of the panel; and a bolt assembled to the nut for fastening the connector and the panel together.

Other objects, advantages and novel features of the invention will become more apparent from the following detailed description when taken in conjunction with the accompany drawings.

DETAILED DESCRIPTION OF PREFERRED EMBODIMENTS

Reference will now be made in detail to the preferred embodiment of the present invention.

Figure 1:
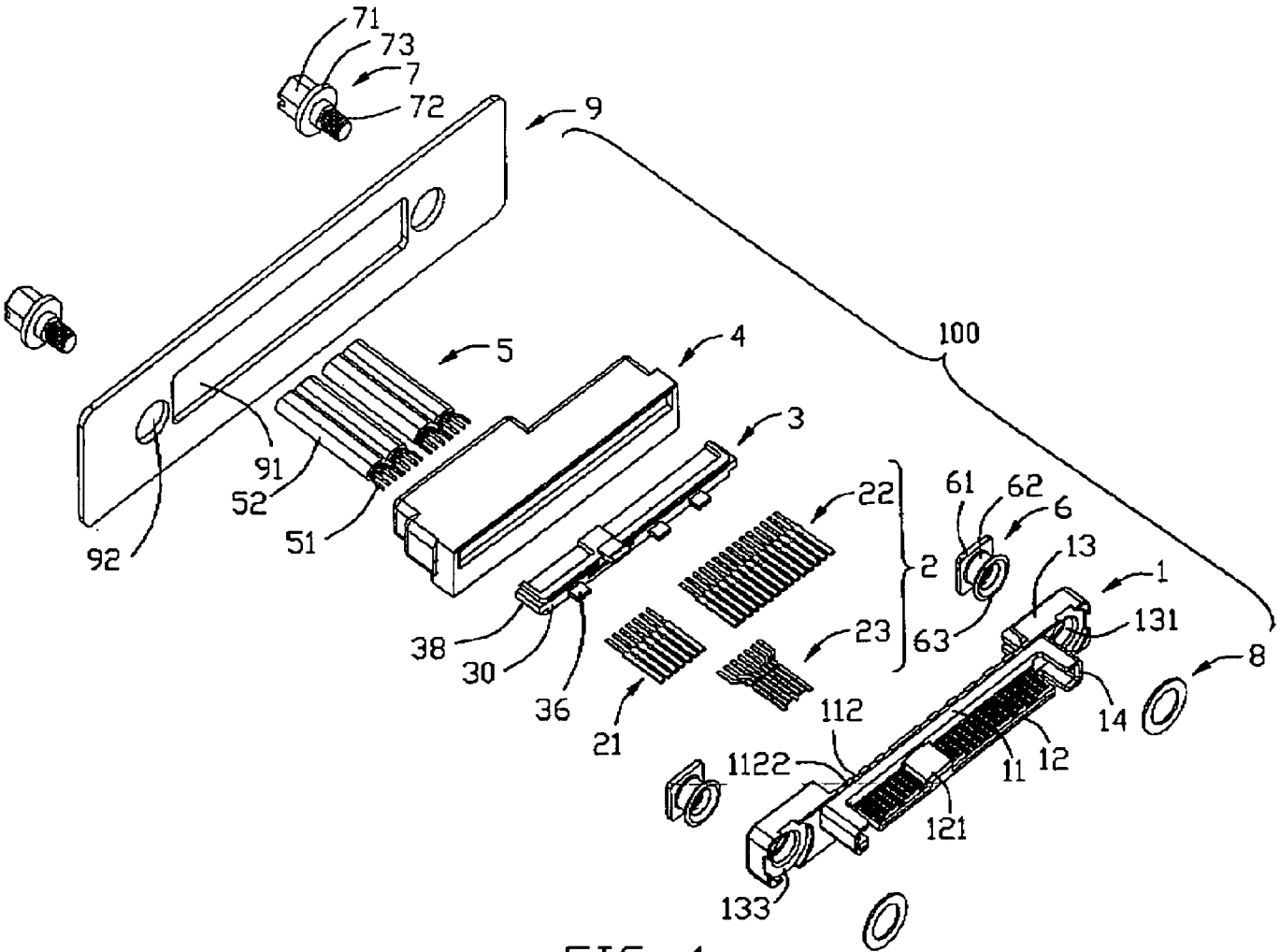
FIG. 1 is an exploded, perspective view of a cable connector assembly and a panel in accordance with the present invention.
Figure 2:
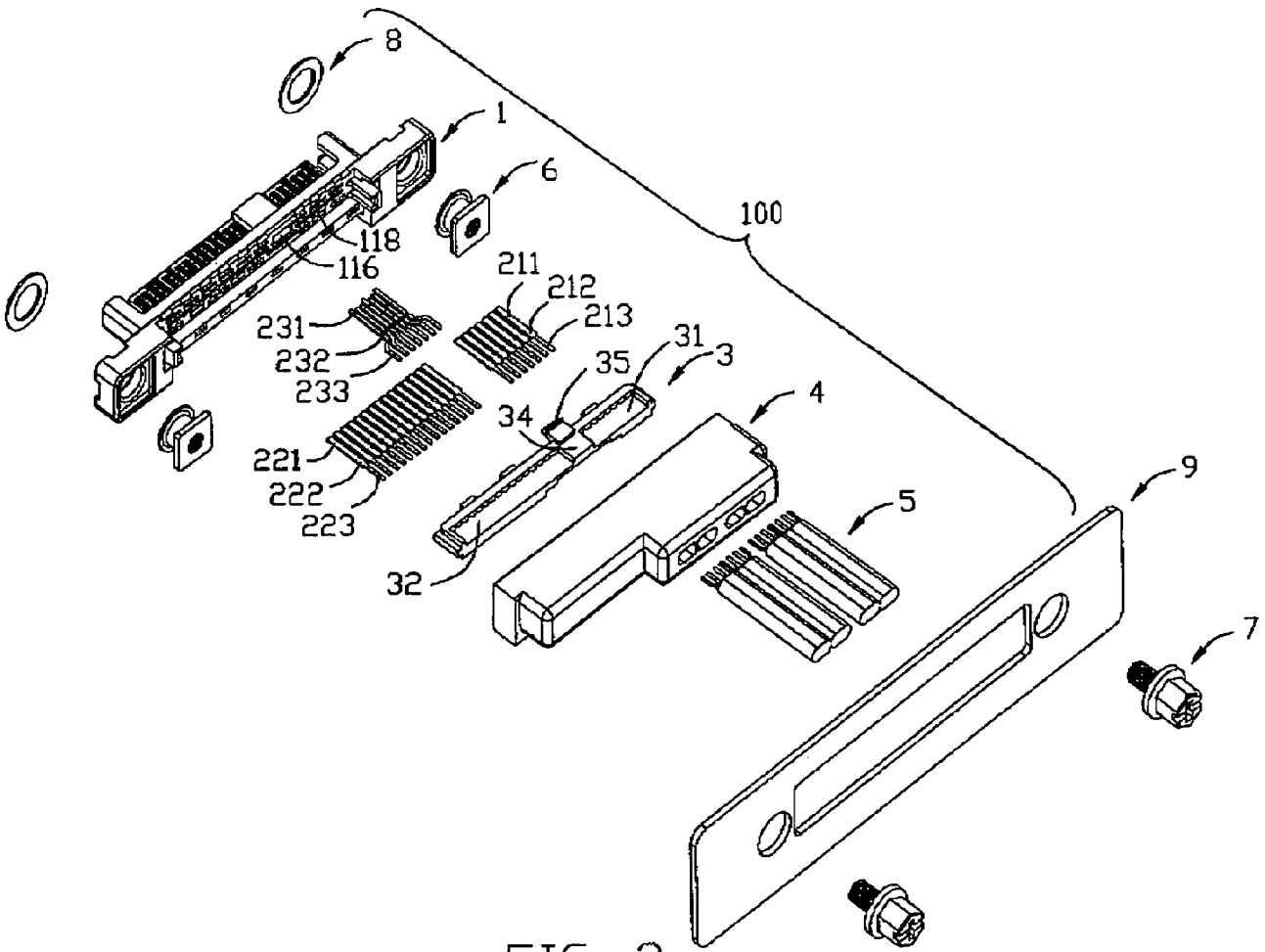
FIG. 2 is similar to FIG. 1, but viewed from another aspect.
Figure 3:
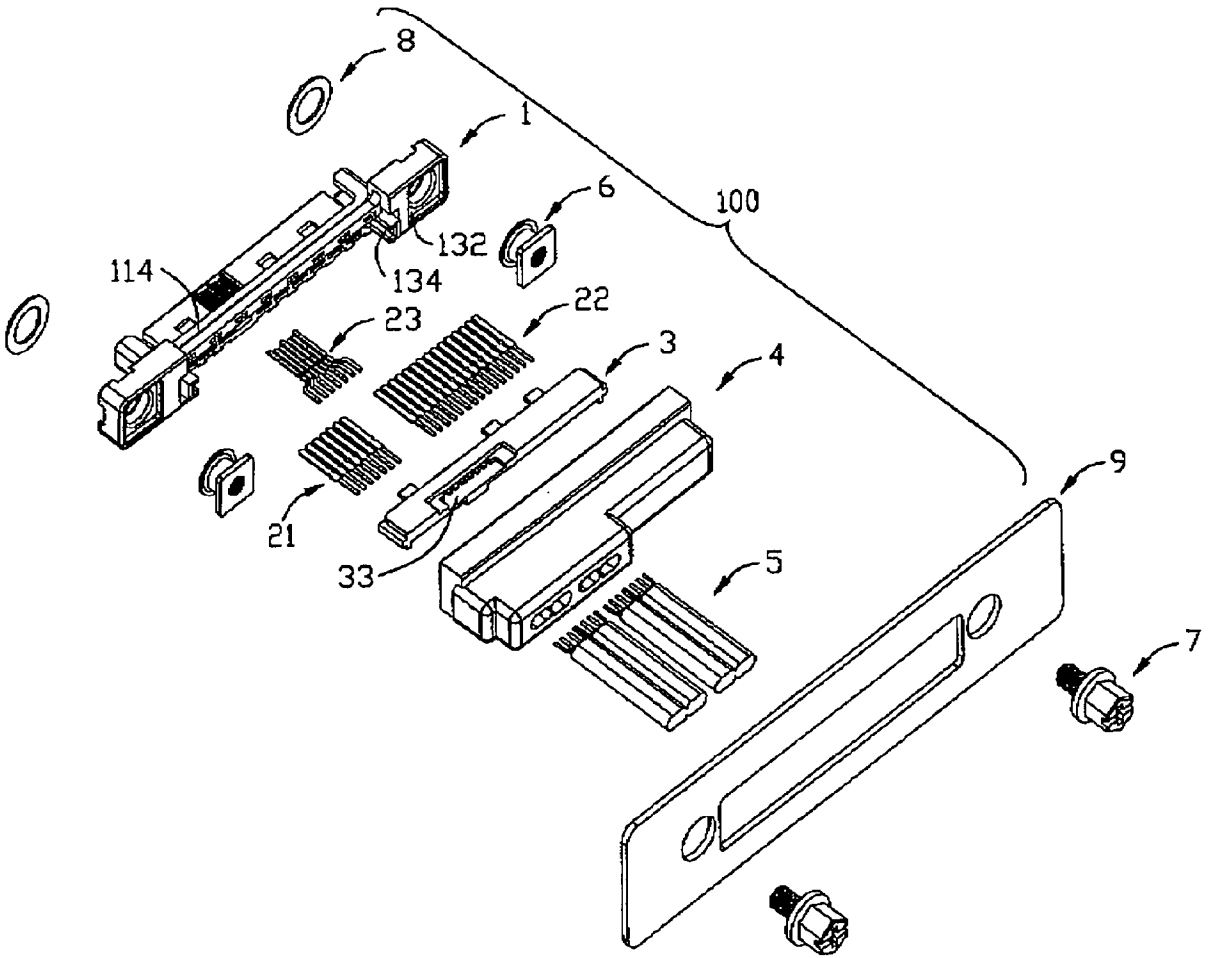
FIG. 3 is similar to FIG. 1, but viewed from other direction.
Figure 4:
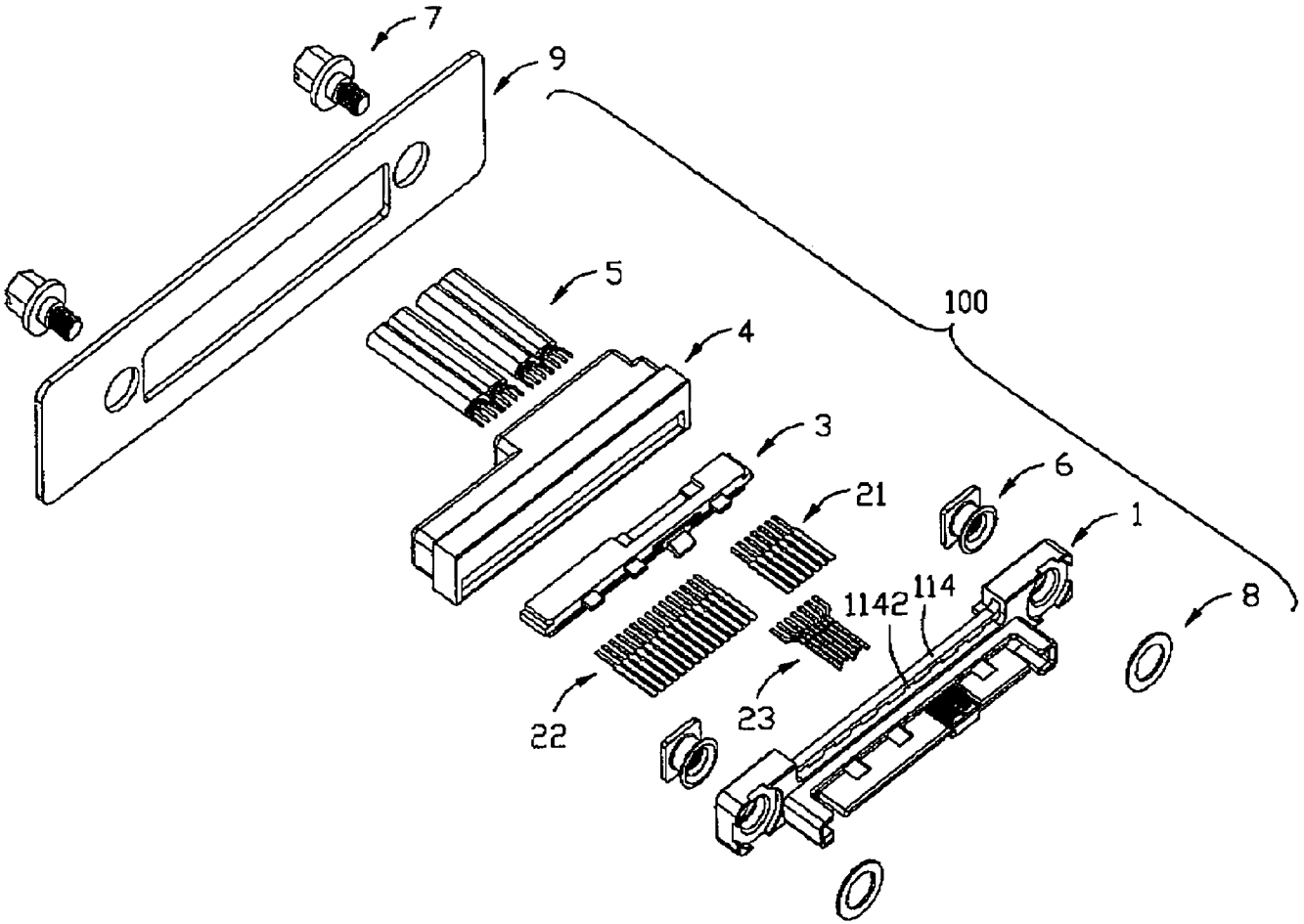
FIG. 4 is similar to FIG. 3, but viewed from another aspect.
Figure 5:
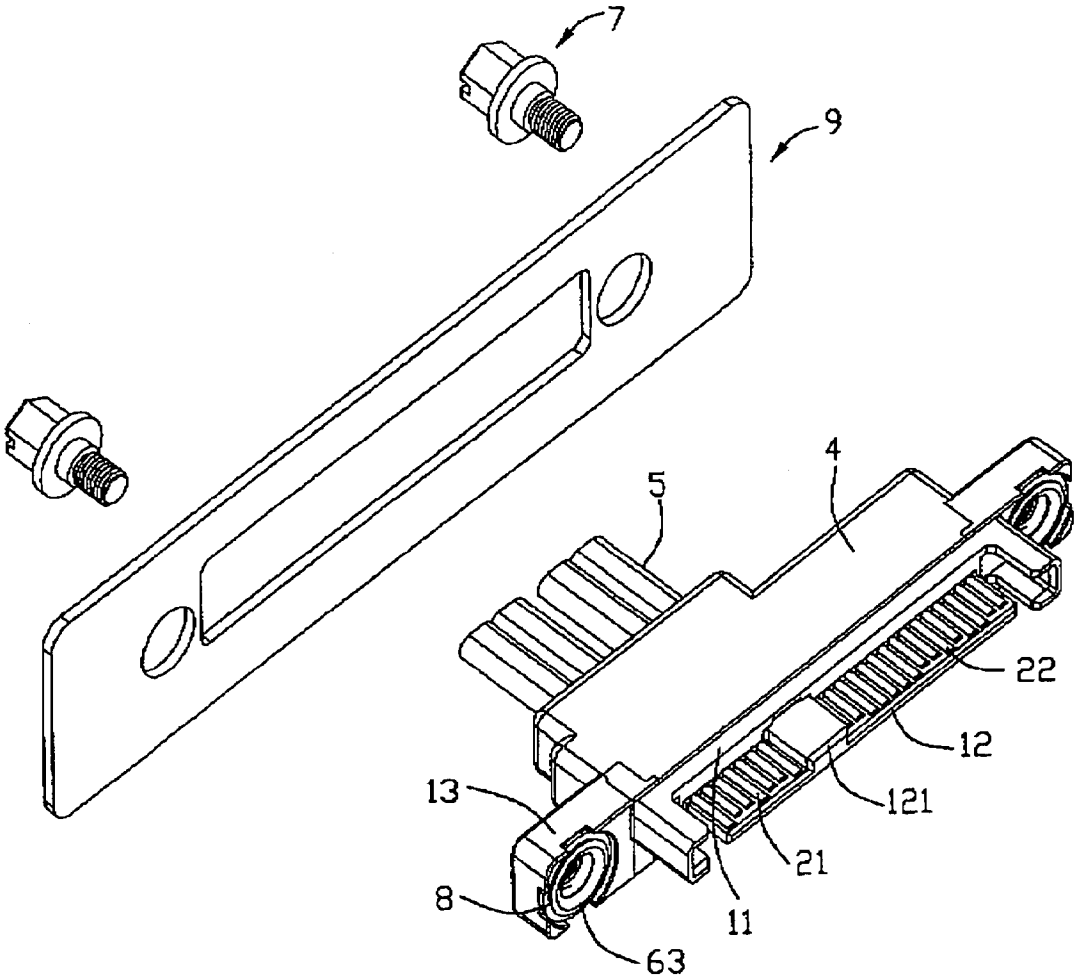
FIG. 5 is an assembled, perspective view of the cable connector assembly.
Figure 6:
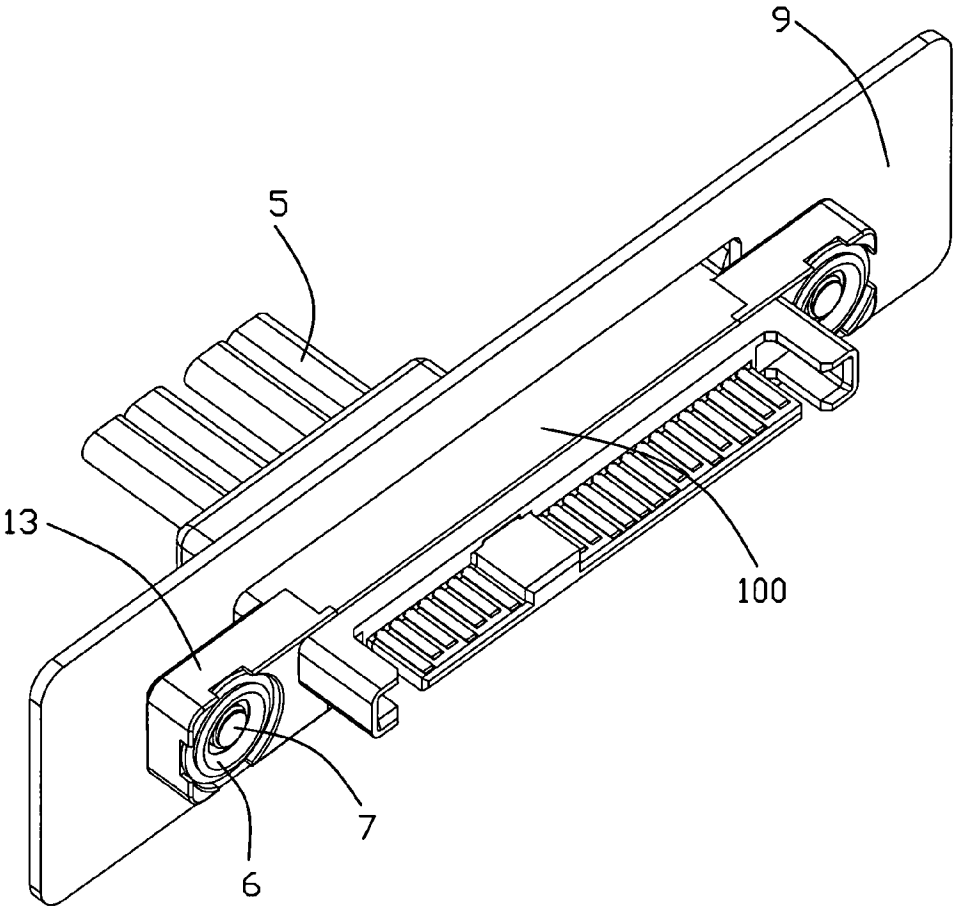
FIG. 6 shows the cable connector assembly mounted to the panel.
Figure 7:
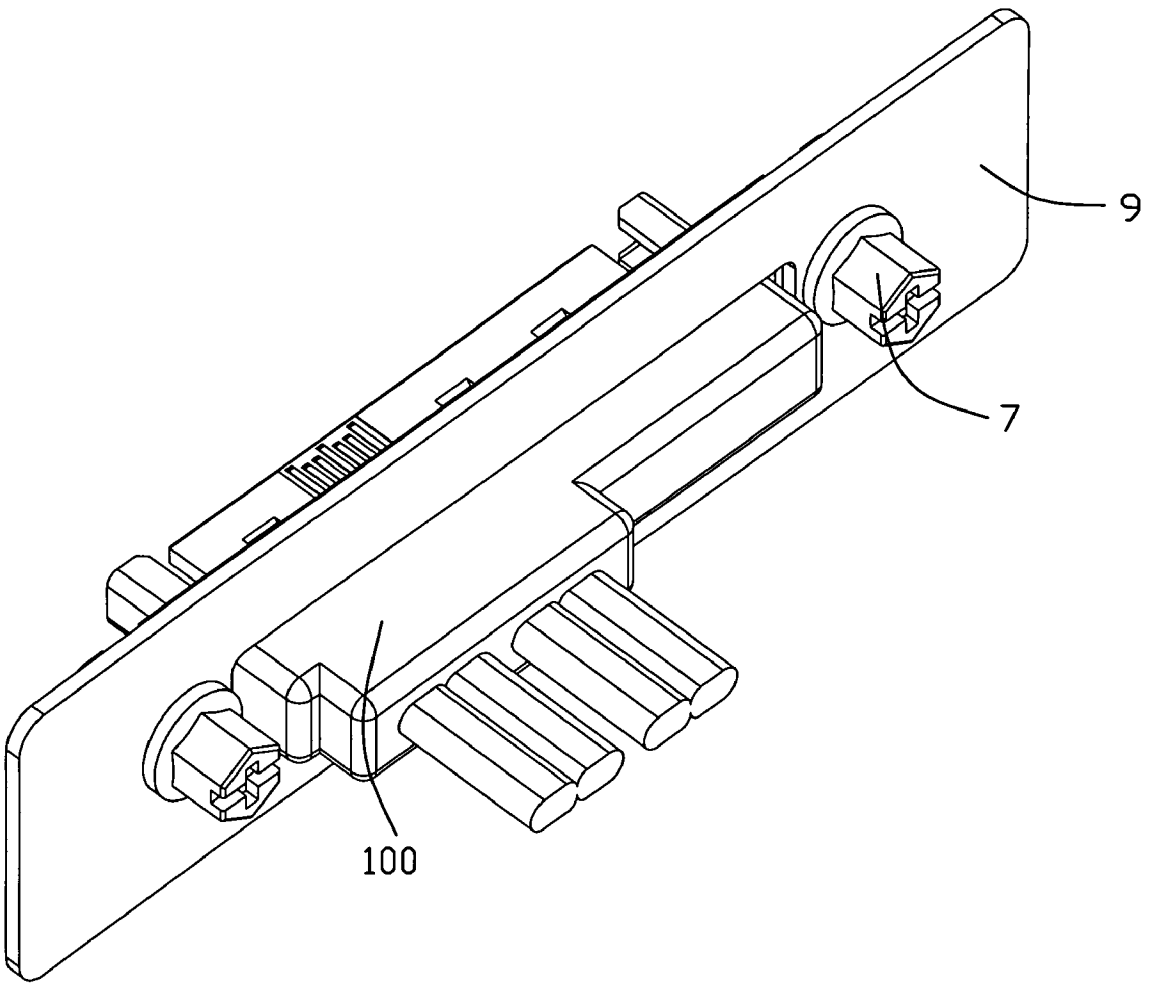
FIG. 7 is similar to FIG. 6, but viewed from another aspect.

Referring to FIGS. 1-7, a cable assembly 100 adapted for mounting to a panel 9 in accordance with the present invention comprises an electrical connector (not numbered) and a number of cables 5 coupled thereto. The panel 9 has an outlet 91 and a pair of mounting holes 92 arranged lateral sides of the outlet 91. The electrical connector has a peripheral portion accommodated in and held by the outlet 91 of the panel 9. The electrical connector comprises an insulated housing 1, a plurality of contacts 2 assembled to the insulated housing 1, a spacer 3, a cover 4 and pair of matched nuts 6 and bolts 7.

The insulated housing 1 includes a base portion 11, a rectangular-shaped tongue portion 12 extending forwardly from a front surface of the base portion 11 and a pair of mounting portions 13 oppositely arranged at a back surface of the base portion 11 and laterally extending outward. A rectangular-shaped platform 121 is arranged on a top surface of tongue portion 12 to divide the top surface into two unsymmetrical areas along a transversal direction. Each mounting portion 13 has a cavity 132 recessed forwardly from a back surface thereof, a circular passage 131 recessed from a central section of a bottom surface the cavity 132 and a depression portion 133 located in front of and further communicating with the passage 131. A longitudinal sunken portion 112 is defined in a rear area of an upper surface of the base portion 11, with a number of spaced protrusions 1122 disposed therein. A beam 114 interconnects the pair of mounting portions 13, adjacent to rear edge of a lower surface of the base portion 11. A plurality of concave portions 1142 are recessed from a front surface of the beam 114. A pair of U-shaped supporting members 134 are respectively attached to lower surfaces of the pair of mounting portions 13, under the beam 114. A pair of U-shaped guiding members 14 extend forwardly from two opposite ends of the base portion 11 for leading the cable assembly 100 properly mating with an complementary connector (not shown).

The contacts 2 are separated into first group of contacts 21, second group of contacts 22 and third group of contacts 23. The first group of contacts 21 and second group of contacts 22 are assembled to an upper section of the insulated housing 1 and spaced by the block 121 along a transversal direction, with mating portions 211, 221 disposed on an upper portion of the tongue portion 12 to form a first interface (not numbered), retention portions 212, 222 retained in an upper portion of the base portion 11, and tail portions 213, 223 rearward extending beyond back surface of the insulated housing 1. While the third group of contacts 23 are assembled to the insulated housing 1 and below the platform 121, with mating portions 231 disposed on a lower portion of the tongue portion 12 to form a second mating interface (not numbered), retention portions 232 retained in a lower portion of the base portion 11, and tail portions 233 rearward extending beyond back surface of the insulated housing 1.

A spacer 3 includes a rectangular-shaped main portion 30, a first sunken portion 31, a second sunken portion 32 are recessed downwardly from a top surface of the main portion 30 and spaced by a rectangular block 34. A third sunken 33 is recessed upwardly from bottom surface of the main portion 30 and under the block 34. The tail portions 213, 223 of the first and second groups of contacts 21, 22 are accommodated in the first and second sunken portions 31, 32, while the tail portions 233 of the third group of contacts 23 are accommodated in the third sunken portion 33. A cantilevered lock member 35 is formed on the top surface of the main portion 30, in front of the block 34. A lock hole 116 is recessed forwardly from back surface of the base portion 11, below the block member 34, and adapted for latching with the lock member 35. Three spaced rectangular-shaped posts 36 extend forwardly from a middle section of front surface of the main portion 30. Corresponding grooves 118 are recessed forwardly form back surface of the base portion 11 for receiving the posts 36. A pair of flange members 38 are arranged at lateral sides of the main portion 30 and adapted for being received in the supporting members 134.

Each nut 6 includes a chassis portion 61 disposed in the cavity 132 of the mounting portion 13, a cylindrical-shaped intermediate portion 62 extending forwardly from the chassis portion 61 and received in the passage 131 of the mounting portion 13 and an expanded stopper 63 formed at a front edge of the intermediate portion 62. Further more, an optional ring-shaped washer member 8 is arranged in the depression portion 133 of the mounting portion 13 and assembled to the nut 6, encircling the intermediate portion 62 and disposed inward side of the stopper 63. Therefore, the nut 6 is permanently fixed to the mounting portion 13 and such configuration is convenient for a user, as the nut 6 is small and difficult for the user to hold it, when the cable connector 100 is assembled to the panel 9. However, in alternative embodiments, the nut may be of different structure and embedded in the mounting portion or other portion of the housing, while the housing is manufactured. As the nut is embedded in the mounting portion, rather than protrude outward of the mounting portion, which may reduce a profile of the connector. A bolt 7 for matching with the nut 6 includes a head 71, a rod extending forwardly from a front surface of the head 71. An optional gasket 73 is also utilized along with the bolt 7.

Each cable 5 includes a number of inner wires 51 and an insulated jacket 52 shielding the inner wires 51. After the inner wires 51 are soldered to tail portions of the contacts 2, a cover 4 is over-molded the base portion 11 of the insulated housing 1, the spacer 3, an interconnection portions between tail portions of the contacts 2 and wires 51 and partial of the cables 5 adjacent to the spacer 3. The protrusions 1122 of the base portion 11 and concave portions 1142 of the beam 114 may increase combination between the housing 1 and the cover 4.

When assemble, the cable assembly 100 attached to a front surface of the panel portion 9, with the pair of mounting portions 13 disposed in front of and adjacent to the pair of mounting holes 92, the cables 5 extending rearward through the outlet 91, and then the pair of bolts 7 are respectively inserted into pair of mounting holes 92 and assembled to the nuts 6 to fasten the insulated housing 1 and the panel 9 together.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector for interconnecting at least a cable and being mountable to a panel having an outlet therethrough and at least a mounting hole arranged alongside the outlet, the connector held in the outlet of the panel, comprising:

an insulated housing including a base portion, a tongue portion extending forwardly from the base portion, and at least a mounting portion integrated with the base portion;

a cover enclosing the base portion of the insulated housing and mounted into the outlet of the panel, with the insulated housing entirely located in front of the panel;

a nut permanently assembled to the mounting portion adapted for aligning with the mounting hole of the panel; and a bolt assembled to the nut for fastening the connector and the panel together;

wherein a platform is formed on a top surface of the tongue portion; and wherein at least a group of contacts are exposed on the top surface of the tongue portion and arranged aside of the platform and another group of contacts are exposed on a bottom surface of the tongue portion and below the platform.

2. The electrical connector as recited in claim 1, wherein the nut includes a chassis portion, an intermediate portion extending forwardly from the chassis portion and received in the mounting portion and an expanded stopper formed at a front edge of the intermediate portion.

3. The electrical connector as recited in claim 2, wherein a cavity is defined in a back portion of the mounting portion to accommodate the chassis portion, wherein a passage is defined in a middle portion of the mounting portion and communicates with the cavity, with the intermediate portion received therein.

4. The electrical connector as recited in claim 3, wherein a depression portion is defined in front portion of the mounting portion and communicates with the passage, wherein a washer member is disposed in the depression portion and assembled with stopper of the nut.

5. The electrical connector as recited in claim 1, wherein a pair of mounting portions are respectively attached to opposite end portions of a back surface of the base portion.

6. The electrical connector as recited in claim 1, wherein a spacer latches with the insulated housing.

7. The electrical connector as recited in claim 6, wherein two sunken portions are respectively defined in an upper portion and lower portion of the spacer.

8. The electrical connector as recited in claim 7, wherein tail portions of the groups of contacts are disposed in corresponding sunken portions, respectively.

9. The electrical connector as recited in claim 1, wherein two U-shaped guiding members extend forwardly from opposite ends of the base portion.

10. A cable assembly adapted for mounting to a panel, said panel having an outlet accommodating the cable assembly, comprising:

an insulated housing configured to be disposed in front of and adjacent to the panel, said insulated housing having a tongue portion with a plurality of contacts disposed thereon to form a mating interface, and a pair of mounting portions arranged at opposite sides of the insulated housing, with two nuts embedded therein, respectively;

at least a cable electrically connecting to the contacts and configured to be arranged back side of the panel;

a cover molded over a rear section of the insulated housing and partial of the cable adjacent to the rear section of the insulated housing; said cover held by the outlet of the panel, with the pair of mounting portions disposed in front of corresponding mounting holes defined in the panel; and two bolts inserted into the corresponding mounting holes from a rear side of the panel and assembled to the two nuts;

wherein the insulated housing further includes a base portion, the tongue portion extending forwardly from the base portion and the insulated housing entirely located in front of the panel;

wherein a platform is formed on a top surface of the tongue portion; and wherein at least one group of the plurality of contacts are exposed on the top surface of the tongue portion and arranged aside of the platform and another group of the plurality of contacts are exposed on a bottom surface of the tongue portion and below the platform.

11. The cable connector assembly as recited in claim 10, wherein the nuts are unseparated from the insulated housing.

12. The cable connector assembly as recited in claim 10, wherein a number of protrusions are formed on a rear section of the base portion.

13. A cable connector assembly comprising:

an insulative housing defining a mating port in a front portion;

a plurality of contacts disposed in the housing with mating sections in the mating port and connection portions linked to corresponding cables in a rear portion of the housing;

a cover covering the rear portion of the housing and front portions of the cables;

a panel defining opposite forward and rearward faces, and a central opening through which the cables and a rear portion of the cover extend; and a pair of through holes formed in the panel and by two sides of the central opening;

a pair of mounting rivets located around two longitudinal ends of the housing, wherein the housing is entirely seated upon the forward face and the cables rearwardly extend beyond the rearward face, under a condition that a pair of screw around the rearward face forwardly extend through the corresponding through holes and fastened to the corresponding mounting rivets, respectively;

wherein a platform is formed on a top surface of the mating port; and wherein at least one group of the plurality of contacts are exposed on the top surface of the mating port and arranged aside of the platform and another group of the plurality of contacts are exposed on a bottom surface of the mating port and below the platform.

14. The cable connector assembly as recited in claim 13, wherein said mating port is forwardly exposed upon the forward face.

15. The cable connector assembly as recited in claim 13, wherein a longitudinal dimension of the central opening is smaller than that of the housing so as to assure that the housing is only allowed to be rearwardly assembled to the forward face.

* * * * *